US010041159B2

(12) United States Patent
Terazawa et al.

(10) Patent No.: US 10,041,159 B2
(45) Date of Patent: Aug. 7, 2018

(54) THICK STEEL PLATE AND PRODUCTION METHOD FOR THICK STEEL PLATE

(71) Applicant: JFE STEEL CORPORATION, Tokyo (JP)

(72) Inventors: Yusuke Terazawa, Tokyo (JP); Katsuyuki Ichimiya, Tokyo (JP); Kenji Hayashi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 416 days.

(21) Appl. No.: 14/770,897

(22) PCT Filed: Feb. 25, 2014

(86) PCT No.: PCT/JP2014/000983
§ 371 (c)(1),
(2) Date: Aug. 27, 2015

(87) PCT Pub. No.: WO2014/132627
PCT Pub. Date: Sep. 4, 2014

(65) Prior Publication Data

US 2016/0010193 A1 Jan. 14, 2016

(30) Foreign Application Priority Data

Feb. 28, 2013 (JP) ..... 2013-038664

(51) Int. Cl.
*C22C 38/58* (2006.01)
*C22C 38/02* (2006.01)
(Continued)

(52) U.S. Cl.
CPC ..... *C22C 38/58* (2013.01); *C21D 6/004* (2013.01); *C21D 6/005* (2013.01); *C21D 6/008* (2013.01);
(Continued)

(58) Field of Classification Search
CPC ..... C21D 6/008; C21D 6/005; C21D 1/26
(Continued)

(56) References Cited

U.S. PATENT DOCUMENTS

2012/0018056 A1* 1/2012 Nakagawa ..... C21D 8/0205 148/506
2014/0290807 A1* 10/2014 Goto ..... C22C 38/58 148/506
2015/0027600 A1* 1/2015 Masuoka ..... C21D 9/46 148/636

FOREIGN PATENT DOCUMENTS

CN 102666885 9/2012
EP 0709480 5/1996
(Continued)

OTHER PUBLICATIONS

Korean Office Action for Korean Application No. 2015-7024914, dated Dec. 19, 2016, including Concise Statement of Relevance of Office Action, 5 pages.
(Continued)

*Primary Examiner* — Scott R Kastler
(74) *Attorney, Agent, or Firm* — RatnerPrestia

(57) ABSTRACT

Provided are a steel plate having high tensile strength, high yield strength, and excellent low-temperature toughness and a method for manufacturing the steel plate.

A steel plate contains 0.04% to 0.15% C, 0.1% to 2.0% Si, 0.8% to 2.0% Mn, 0.025% or less P, 0.020% or less S, 0.001% to 0.100% Al, 0.010% to 0.050% Nb, and 0.005% to 0.050% Ti and further contains Cu, Ni, Cr, Mo, and N on a mass basis such that 0.5%≤Cu+Ni+Cr+Mo≤3.0% and 1.8≤Ti/N≤4.5 are satisfied, the remainder being Fe and inevitable impurities. The area fraction of polygonal ferrite is less than 10%. The effective grain size at the through-
(Continued)

thickness center is 15 μm or less. The standard deviation of the effective grain size is 10 μm or less.

4 Claims, 1 Drawing Sheet

(51) Int. Cl.

| | |
|---|---|
| ***C22C 38/04*** | (2006.01) |
| ***C22C 38/12*** | (2006.01) |
| ***C22C 38/14*** | (2006.01) |
| ***C21D 6/00*** | (2006.01) |
| ***C21D 8/02*** | (2006.01) |
| ***C22C 38/00*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| *C21D 9/46* | (2006.01) |

(52) U.S. Cl.
CPC ..... *C21D 8/0226* (2013.01); *C21D 8/0263* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 9/46* (2013.01); *C21D 2201/05* (2013.01); *C21D 2211/002* (2013.01); *C21D 2211/005* (2013.01); *C21D 2211/008* (2013.01)

(58) Field of Classification Search
USPC ..... 148/506, 507
See application file for complete search history.

(56) References Cited

FOREIGN PATENT DOCUMENTS

| | | |
|---|---|---|
| EP | 2813596 | 12/2014 |
| JP | 05195058 | 8/1993 |
| JP | 2001049385 | 2/2001 |
| JP | 2001064723 | 3/2001 |
| JP | 2001064727 | 3/2001 |
| JP | 2001123245 | 5/2001 |
| JP | 2001200334 | 7/2001 |
| JP | 2002294405 | 10/2002 |
| JP | 2003129133 | 5/2003 |
| JP | 2003321729 | 11/2003 |
| JP | 2007211278 | 8/2007 |
| JP | 2009074111 | 4/2009 |
| JP | 2010248599 | 11/2010 |
| JP | 2011195883 | 10/2011 |
| JP | 2011218370 | 11/2011 |
| JP | 2012172258 | 9/2012 |
| JP | 2012184500 | 9/2012 |
| WO | 9905335 | 2/1999 |
| WO | 2009072753 | 6/2009 |
| WO | 2011099408 | 8/2011 |

OTHER PUBLICATIONS

Chinese Office Action dated Apr. 1, 2016 with partial English translation for Application No. 2014800098690, 10 pages.
European Office Action for Application No. 14 757 273.9, dated Aug. 2, 2017, 6 pages.
International Search Report for International Application No. PCT/JP2014/000983 dated May 27, 2014.

* cited by examiner

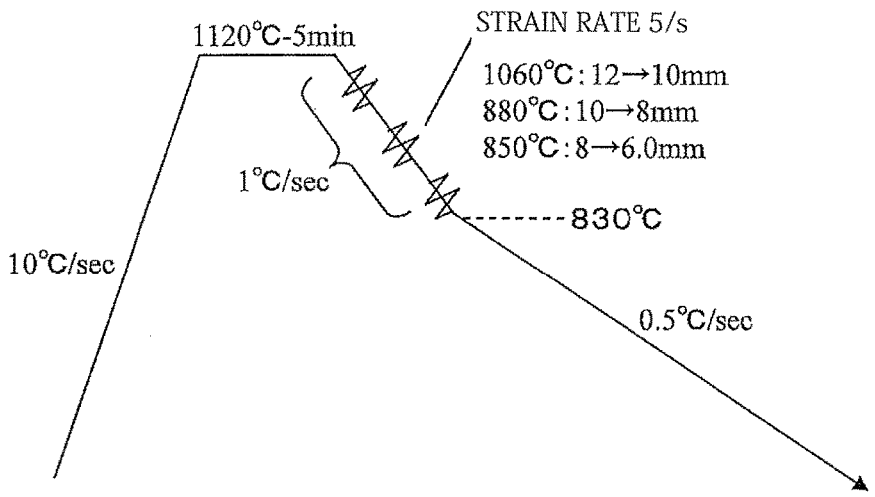
1120°C-5min
STRAIN RATE 5/s
1060°C : 12→10mm
880°C : 10→8mm
850°C : 8→6.0mm
1°C/sec
830°C
10°C/sec
0.5°C/sec

THICK STEEL PLATE AND PRODUCTION METHOD FOR THICK STEEL PLATE

CROSS-REFERENCE TO RELATED APPLICATION

This is the U.S. National Phase application of PCT International Application No. PCT/JP2014/000983, filed Feb. 25, 2014, and claims priority to Japanese Patent Application No. 2013-038664, filed Feb. 28, 2013, the disclosures of each of these applications being incorporated herein by reference in their entireties for all purposes.

FIELD OF THE INVENTION

Aspects of the present invention relate to a steel plate, having excellent toughness under low-temperature circumstances, for use in marine structures, construction machines, bridges, pressure vessels, storage tanks, buildings, and the like and a method for manufacturing the same.

BACKGROUND OF THE INVENTION

Steel plates for use in marine structures, construction machines, bridges, pressure vessels, storage tanks, buildings, and the like are required to have high toughness from the viewpoint of safety in addition to high yield strength and high tensile strength.

In general, in order to achieve high strength and high toughness in steel microstructures, the refinement of grains is known to be effective. For example, Patent Literatures 1 to 8 disclose a method for increasing the toughness of a steel plate or sheet by microstructural refinement.

PATENT LITERATURE

PTL 1: Japanese Unexamined Patent Application Publication No. 2010-248599

PTL 2: Japanese Unexamined Patent Application Publication No. 2009-74111

PTL 3: Japanese Unexamined Patent Application Publication No. 2003-129133

PTL 4: Japanese Unexamined Patent Application Publication No. 2011-195883

PTL 5: Japanese Unexamined Patent Application Publication No. 2001-49385

PTL 6: Japanese Unexamined Patent Application Publication No. 2001-200334

PTL 7: Japanese Unexamined Patent Application Publication No. 2001-64727

PTL 8: Japanese Unexamined Patent Application Publication No. 2001-64723

SUMMARY OF THE INVENTION

In recent years, the use of steel plates under more severe circumstances, particularly under lower temperature circumstances, has been investigated. Therefore, in order to increase the safety of buildings, a ½t portion (through-thickness central portion) of each steel plate is required to have further increased toughness.

However, in a method described in Patent Literatures 1 and 2, the low-temperature toughness (toughness under low-temperature circumstances) of a through-thickness central portion may possibly be insufficient depending on applications.

In a method described in Patent Literature 3, even though the average size of grains is fine, partly present coarse grains may possibly act as the origin of brittle fracture. In this case, a variation or a reduction in toughness is caused.

In a method described in Patent Literature 4, the microstructure of a steel plate or sheet is partly transformed into polygonal ferrite and therefore high yield strength cannot be stably satisfied in some cases. Furthermore, in a method in which heavy reduction rolling is performed with a high rolling shape factor one pass as described in Patent Literature 4, the number of passes is one and therefore recrystallization does not occur uniformly in any of grains. As a result, fine grains due to recrystallization and remaining coarse grains are present in a mixed state. In such a state, coarse grains with reduced toughness act as the origin of brittle fracture; hence, good toughness is not achieved.

In a method in which reduction rolling is performed with a high rolling shape factor as described in Patent Literatures 5 to 8, when the strain induced by single rolling is insufficient, no recrystallization occurs and added dislocations are removed by recovery. Therefore, microstructural refinement does not occur or good toughness is not achieved.

Aspects of the present invention solve the above problems. It is an object of the present invention to provide a steel plate preferably having high tensile strength, high yield strength, and excellent low-temperature toughness and a method for manufacturing the steel plate.

The inventors have performed intensive investigations to solve the above problems. The inventors have found that a steel plate having high tensile strength, high yield strength, and excellent low-temperature toughness is obtained by adjusting the area fraction of polygonal ferrite, the effective grain size at the through-thickness center, and the standard deviation of the effective grain size using a steel plate with a specific composition. This has led to the completion of the present invention. Aspects of the present invention provide the following.

A first embodiment of the invention provides a steel plate containing 0.04% to 0.15% C, 0.1% to 2.0% Si, 0.8% to 2.0% Mn, 0.025% or less P, 0.020% or less S, 0.001% to 0.100% Al, 0.010% to 0.050% Nb, and 0.005% to 0.050% Ti on a mass basis, the steel plate further containing Cu, Ni, Cr, Mo, and N on a mass basis such that $0.5\% \leq Cu+Ni+Cr+Mo \leq 3.0\%$ and $1.8 \leq Ti/N \leq 4.5$ are satisfied, the remainder being Fe and inevitable impurities. The area fraction of polygonal ferrite is less than 10%. The effective grain size at the through-thickness center is 15 μm or less. The standard deviation of the effective grain size is 10 μm or less.

A second embodiment of the invention provides the steel plate, specified in the first embodiment of the invention, further containing one or more of 0.01% to 0.10% V, 0.01% to 1.00% W, 0.0005% to 0.0050% B, 0.0005% to 0.0060% Ca, 0.0020% to 0.0200% of a REM, and 0.0002% to 0.0060% Mg on a mass basis.

A third embodiment of the invention provides a method for manufacturing the steel plate specified in the first or second embodiments of the invention. The method includes a heating step of heating a steel plate having the composition specified in the first embodiment of the invention or the second embodiment of the invention to a temperature of 950° C. to 1,150° C., a recrystallization temperature region rolling step of performing rolling with a rolling shape factor of 0.5 or more and a rolling reduction of 6.0% or more per pass at a through-thickness center temperature of 930° C. to 1,050° C. three or more passes after the heating step, a non-recrystallization temperature region rolling step of performing rolling with a rolling shape factor of 0.5 or more and a total rolling reduction of 35% or more at a through-thickness center temperature of lower than 930° C. one or more passes after the recrystallization temperature region rolling step, and a cooling step of performing cooling under conditions where cooling is started at a through-thickness center temperature of $Ar_3$ ($Ar_3$ transformation point: hereinafter designated as $Ar_3$)+15° C. or more and the average cooling rate of the through-thickness center from 700° C. to 500° C. is 3.5° C./sec or more after the non-recrystallization temperature region rolling step.

A fourth embodiment of the invention provides the manufacturing method, specified in the third embodiment of the invention, further including a tempering step of tempering at a temperature of 700° C. or lower after the cooling step.

A steel plate according to the present invention and a steel plate manufactured by a manufacturing method according to the present invention may have high tensile strength, high yield strength, and excellent low-temperature toughness.

BRIEF DESCRIPTION OF THE DRAWINGS

FIG. 1 is a graph showing conditions for a thermal expansion test for determining $Ar_3$.

DETAILED DESCRIPTION OF EMBODIMENTS OF THE INVENTION

Embodiments of the present invention are described below. The present invention is not limited to the embodiments below.

A steel plate according to an embodiment of the present invention contains 0.04% to 0.15% C, 0.1% to 2.0% Si, 0.8% to 2.0% Mn, 0.025% or less P, 0.020% or less S, 0.001% to 0.100% Al, 0.010% to 0.050% Nb, and 0.005% to 0.050% Ti on a mass basis and further contains Cu, Ni, Cr, Mo, and N on a mass basis such that $0.5\% \leq Cu+Ni+Cr+Mo \leq 3.0\%$ and $1.8 \leq Ti/N \leq 4.5$ are satisfied, the remainder being Fe and inevitable impurities. Components contained in the steel plate are described below. Incidentally, in descriptions below, the unit "%" used to express the content of each component refers to "mass percent".

C: 0.04% to 0.15%

C is an element increasing the strength of the steel plate. In aspects of the present invention, in order to ensure the strength of the steel plate, the lower limit of the content of C is 0.04%. When the content of C is more than 0.15%, the steel plate has reduced weldability. Therefore, in aspects of the present invention, the upper limit of the content of C is 0.15%. The lower limit and upper limit of the content of C are preferably 0.045% and 0.145%, respectively.

Si: 0.1% to 2.0%

Si is an element mainly increasing the yield strength of the steel plate by solid solution hardening. In aspects of the present invention, in order to ensure the yield strength thereof, the lower limit of the content of Si is 0.1%. When the content of Si is more than 2.0%, the steel plate has reduced weldability. Therefore, in aspects of the present invention, the upper limit of the content of Si is 2.0%. The lower limit and upper limit of the content of Si are preferably 0.10% and 1.90%, respectively.

Mn: 0.8% to 2.0%

Mn is an element increasing the strength of the steel plate by the enhancement in hardenability of steel. However, when Mn is excessively contained, the steel plate has reduced weldability. Therefore, in aspects of the present invention, the content of Mn is 0.8% to 2.0% and preferably 1.10% to 1.80%.

P: 0.025% or less

P is an element that is inevitably present in steel in the form of an impurity. P may possibly reduce the toughness of steel. Therefore, the content of P is preferably minimized. In particular, when more than 0.025% P is contained, the steel plate tends to have reduced toughness. In aspects of the present invention, the content of P is 0.025% or less and preferably 0.010% or less.

S: 0.020% or less

S is an element that is inevitably present in steel in the form of an impurity. S may possibly reduce the toughness of steel and the drawability determined by a through-thickness tensile test. Therefore, the content of S is preferably minimized. In particular, when the content of S is more than 0.020%, the reduction of the above properties tends to be significant. Therefore, in aspects of the present invention, the content of S is 0.020% or less and preferably 0.004% or less.

Al: 0.001% to 0.100%

Al is an element which acts as a deoxidizing agent and which is most commonly used as a deoxidizing agent in a process for a deoxidizing molten steel. In order to allow Al to sufficiently function as a deoxidizing agent, the lower limit of the content of Al is 0.001%. However, when the content of Al is more than 0.100%, Al tends to form coarse carbides to reduce the ductility of the steel plate. Therefore, in aspects of the present invention, the upper limit of the content of Al is 0.100%. The lower limit and upper limit thereof are preferably 0.003% and 0.050%, respectively.

Nb: 0.010% to 0.050%

Nb is an element which expands the non-recrystallization temperature region of an austenite phase and which is desirable to efficiently perform rolling in the non-recrystallization temperature region to obtain a desired microstructure. Therefore, the content of Nb is 0.010% or more. However, when the content of Nb is more than 0.050%, a reduction in toughness is caused. Hence, the upper limit thereof is 0.050%. Incidentally, the lower limit and upper limit of the content of Nb are preferably 0.015% and 0.035%, respectively.

Cu+Ni+Cr+Mo: 0.5% to 3.0%

Cu, Ni, Cr, and Mo are elements that enhance the hardenability of steel to increase the strength of the steel plate. When the total content of these elements is 0.5% or more, the formation of polygonal ferrite can be suppressed and the yield strength can be increased. However, when the total content thereof is more than 3.0%, the steel plate has reduced weldability. Therefore, in aspects of the present invention, the total content of Cu, Ni, Cr, and Mo is 0.5% to 3.0% and the lower limit and upper limit thereof are preferably 0.7% and 2.5%, respectively. Incidentally, a symbol for each element of "Cu+Ni+Cr+Mo" represents the content of the elements.

Ti: 0.005% to 0.050%

Ti precipitates in the form of TiN and, as a result, suppresses the coarsening of austenite grains during slab heating before a steel plate is rolled. As described above, Ti is an element which contributes to the refinement of a final microstructure obtained after rolling and which is effective in increasing the toughness of the steel plate. In order to achieve such an effect, the content of Ti is 0.005% or more. However, when the content of Ti is more than 0.050%, weld heat-affected zones have reduced toughness. Therefore, in aspects of the present invention, the content of Ti is 0.005% to 0.050% and the lower limit and upper limit thereof are preferably 0.005% and 0.040%, respectively.

N satisfying 1.8≤Ti/N≤4.5

When 1.8>Ti/N (mass ratio), TiN is likely to be melted during slab heating and therefore the effect of suppressing the coarsening of austenite grains is unlikely to be obtained. Furthermore, the presence of solute N deteriorates the toughness of the steel plate. However, when Ti/N>4.5, Ti is excessively present with respect to N and forms coarse TiC to reduce the toughness of the steel plate. Therefore, Ti/N is preferably limited to the range 1.8≤Ti/N≤4.5 and more preferably satisfies 2.0≤Ti/N≤4.0.

The steel plate according to aspects of the present invention preferably has a basic composition containing the above components. The steel plate according to aspects of the present invention may further contain one or more of 0.01% to 0.10% V, 0.01% to 1.00% W, 0.0005% to 0.0050% B, 0.0005% to 0.0060% Ca, 0.0020% to 0.0200% of a REM, and 0.0002% to 0.0060% Mg for the purpose of adjusting the strength and the toughness and for the purpose of increasing the toughness of a joint.

V: 0.01% to 0.10%

V is an element which further increases the strength and toughness of the steel plate and which exhibits such an effect by the addition of 0.01% or more. However, when the content of V is more than 0.10%, a reduction in toughness may possibly be caused. Therefore, the upper limit of the content of V is preferably 0.10%. Incidentally, the content of V is more preferably 0.03% to 0.08%.

W: 0.01% to 1.00%

W is an element which increases the strength of the steel plate and which exhibits such an effect by the addition of 0.01% or more. However, when the content of W is more than 1.00%, there may possibly be a problem with a reduction in weldability. Thus, the content of W is preferably 0.01% to 1.00%. Incidentally, the content of V is more preferably 0.05% to 0.15%.

B: 0.0005% to 0.0050%

B is an element which enhances the hardenability even when the content thereof is very small and which is thereby effective in increasing the strength of the steel plate. In order to achieve such effects, the content of B is preferably 0.0005% or more. However, when more than 0.0050% B is contained, the weldability may possibly be low. Therefore, the upper limit of the content of B is preferably 0.0050%.

Ca: 0.0005% to 0.0060%

Ca fixes S to suppress the production of MnS, thereby improving through-thickness drawing characteristics. Furthermore, Ca has the effect of improving the toughness of weld heat-affected zones. In order to achieve such effects, the content of Ca is preferably 0.0005% or more. However, when more than 0.0060% Ca is contained, the steel plate may possibly have reduced toughness. Therefore, the upper limit of the content of Ca is preferably 0.0060%.

REM: 0.0020% to 0.0200%

The REM fixes S to suppress the production of MnS, thereby improving through-thickness drawing characteristics. Furthermore, the REM has the effect of improving the toughness of weld heat-affected zones. In order to achieve such effects, the content of the REM is preferably 0.0020% or more. However, when more than 0.0200% of the REM is contained, the steel plate may possibly have reduced toughness. Therefore, the upper limit of the content of the REM is preferably 0.0200%.

Mg: 0.0002% to 0.0060%

Mg is an element which suppresses the growth of austenite grains in a weld heat-affected zone and which is effective in improving the toughness of the weld heat-affected zone. In order to achieve such effects, the content of Mg is preferably 0.0002% or more. However, it may possibly be economically disadvantageous to contain more than 0.0060% Mg because the effect is saturated and any advantage appropriate to the content thereof cannot be expected. Therefore, the upper limit of the content of Mg is preferably 0.0060%.

The remainder other than the above components are Fe and the inevitable impurities. Herein, the inevitable impurities are O and the like. O is a typical inevitable impurity that is inevitably trapped in the course of producing steel. Although a typical inevitable impurity is O, the inevitable impurities refer to components other than the above essential components. Thus, those intentionally or incidentally containing an arbitrary component in such an amount that advantages of the polyimide are not impaired are within the scope of the present invention.

Next, the microstructure of an exemplary, non-limiting steel plate is described.

Area Fraction of Polygonal Ferrite: Less than 10%

When the area fraction of polygonal ferrite is 10% or more, the steel plate has reduced yield strength. Therefore, in the steel plate according to the embodiments of present invention, the area fraction of polygonal ferrite is limited to less than 10%. Incidentally, the area fraction thereof is preferably 8% or less and most preferably 5% or less. Herein, the area fraction of polygonal ferrite refers to the percentage of polygonal ferrite in an observation surface of the microstructure of the steel plate. The microstructure of the steel plate is observed in such a manner that after a through-thickness cross section of the steel plate that is parallel to the rolling direction of the steel plate is polished, the through-thickness cross section is corroded with 3% nital and ten fields of view of the corroded through-thickness cross section are observed with a SEM (scanning electron microscope) at 2,000× magnification. A commercially available image-processing software program or the like can be used to derive the area fraction thereof.

In the steel plate according to the embodiments of the present invention, main textures are bainite and martensite. The grain size of a crystal microstructure is preferably small. In the present invention, the grain size refers to the effective grain size below.

Effective Grain Size: 15 μm or Less

In the steel plate according to embodiments of the present invention, the effective grain size at the through-thickness center is 15 μm or less. When the effective grain size is more than 15 the steel plate has reduced toughness. The effective grain size is more preferably 10 or less. The effective grain size can be derived by an EBSP (electron backscatter diffraction pattern) method. The effective grain size is obtained by deriving the average of the effective grain size in the observation surface. Incidentally, a commercially available image-processing software program or the like can be used to derive the effective grain size.

The effective grain size is measured in such a manner that a cross section which is taken from the through-thickness center of steel plate and which is parallel to the rolling direction is mirror-polished and a 5 mm×5 mm region of the through-thickness center is subjected to EBSP analysis. Even if a sample with an effective grain size of more than 15 μm is present in this range, one which has an effective grain size of 15 μm or less and which accounts for 80% or more of the whole is within the preferred scope of the present invention.

Standard Deviation of Effective Grain Size: 10 μm or Less

In embodiments of the present invention, the standard deviation of the size distribution of the effective grain size may be 10 μm or less. When the standard deviation thereof is more than 10 μm, partly present coarse grains act as the origin of brittle fracture to reduce the toughness of the steel plate. In the present invention, the standard deviation thereof is preferably 7 μm or less.

Next, an exemplary method for manufacturing the steel plate according to aspects of the present invention is described. The method and conditions for manufacturing the steel plate according to the present invention are not particularly limited. The steel plate according to the present invention can be manufactured by, for example, a method including a heating step, a recrystallization temperature region rolling step, a non-recrystallization temperature region rolling step, and a cooling step.

It is beneficial for the steel plate according to aspects the present invention that the grain size of a crystal microstructure is minimized. A way to achieve this aim is, e.g., as follows: austenite grains are refined by heavy reduction rolling in the recrystallization temperature region of austenite, transformation nuclei are introduced by reduction rolling in the non-recrystallization temperature region of austenite, and rapid cooling is then performed.

In the recrystallization temperature region rolling step, whether recrystallization occurs during reduction rolling in each pass depends on the strain applied in the pass. In the non-recrystallization temperature region rolling step, an effect of transformation nuclei due to the strain induced by reduction rolling depends on the sum of strains. Furthermore, in every rolling step, a rolling shape factor (hereinafter also designated as ld/hm), given by the following equation, may, e.g., in each rolling pass be large in order to apply strain, if desired, to the through-thickness center:

$$ld/hm=\{R(h_i-h_o)\}^{1/2}/\{(h_i+2h_o)/3\}$$

where ld is the projected contact arc length, hm is the average thickness of a plate, R is the radius of rolls, $h_i$ is the thickness of the input plate, and $h_o$ is the thickness of the output plate in the rolling pass.

The average size of the microstructure of the through-thickness center is refined by varying the pass schedule, the rolling reduction, and the rolling shape factor and the variation in size of the microstructure may be reduced, whereby the steel plate can be manufactured so as to have excellent low-temperature toughness and so as to have yield strength and tensile strength above a certain level. Details of each step and conditions preferably used in the step are as described below. Incidentally, the rolling shape factor is given by the above equation and relates to the through-thickness strain distribution developed during rolling. When the rolling shape factor is small, strain is likely to be concentrated on a surface of the steel plate. In the case of rolls with the same diameter, the rolling shape factor is reduced by reducing the rolling reduction. When the rolling shape factor is large, strain is likely to be introduced into not only a surface of the steel plate but also the through-thickness center thereof. In order to increase the rolling shape factor, the rolling reduction may be increased in the case of using such rolls with the same diameter.

The heating step is a step of heating a steel plate having the above composition. In this step, the steel plate or sheet is preferably heated to a temperature of 950° C. to 1,150° C. When the heating temperature is lower than 950° C., non-transformed austenite is partly formed and therefore advantageous characteristics are not obtained after rolling. However, when the heating temperature is higher than 1,150° C., austenite grains are become coarse and therefore a fine grain structure which is the microstructure of a desired steel plate is not obtained after controlled rolling. In this step, the heating temperature is preferably 950° C. to 1,120° C.

The recrystallization temperature region rolling step is a step of performing rolling with a rolling shape factor of 0.5 or more and a rolling reduction of 6.0% or more per pass at a through-thickness center temperature of 930° C. to 1,050° C. three or more passes. The strain applied to the steel plate during rolling varies depending on a through-thickness position. As the rolling shape factor is small, the magnitude of the strain applied to the through-thickness center is small. In order to apply a stress equivalent to the rolling reduction to the through-thickness center, the rolling shape factor is preferably adjusted to 0.5 or more. In order to induce recrystallization, the rolling reduction is preferably 6.0% or more per pass and is more preferably 8% or more per pass.

When the temperature of the through-thickness center during this step is lower than 930° C., recrystallization is unlikely to occur and an advantageous number of fine austenite grains do not tend to be formed. At a temperature higher than 1,050° C., the effect of refining grains by recrystallization during rolling is low. Therefore, the above through-thickness center temperature is preferably 930° C. to 1,050° C. Incidentally, the through-thickness center temperature used is a calculation value obtained by the calculation of heat transfer by conduction, heat transfer by convection, and heat transfer by radiation in consideration of the spray of descaling water and cooling water for the temperature adjustment of the steel plate.

In this step, when the number of times reduction rolling is performed with a rolling shape factor of 0.5 or more and a rolling reduction of 6.0% or more per pass at a through-thickness center temperature of 930° C. to 1,050° C. is two or less, recrystallization does not occur and coarse grains remain partly. When the rolling reduction per pass is small or the number of times reduction rolling is performed is small, a through-thickness central portion particularly has significantly reduced toughness.

The non-recrystallization temperature region rolling step is a step of performing rolling with a rolling shape factor of 0.5 or more and a rolling reduction or total rolling reduction of 35% or more at a through-thickness center temperature of lower than 930° C. one or more passes after the recrystallization temperature region rolling step.

In the case of performing this step at 930° C. or higher, recrystallization is likely to occur and the introduced strain is dissipated during recrystallization, therefore is not accumulated, and may not be used to form transformation nuclei; hence, the final microstructure is coarse.

In this step, when the rolling shape factor is less than 0.5 or when the rolling reduction or the total rolling reduction is less than 35%, the strain applied to the through-thickness center is small and therefore an advantageous number of fine grains are not formed during the transformation of an austenite phase. Rolling is preferably performed two or more passes. The range of the total rolling reduction is preferably 45% or more.

The cooling step is a step of performing cooling under conditions where cooling is started at a through-thickness center temperature of $Ar_3$+15° C. or more and the average cooling rate of the through-thickness center from 700° C. to 500° C. is 3.5° C./sec or more after the non-recrystallization temperature region rolling step.

When the cooling start temperature of the through-thickness center is lower than $Ar_3$+15° C., ferrite transformation occurs before the rapid cooling of the through-thickness center is started, thereby reducing the yield strength of the steel plate. Therefore, the cooling start temperature of the through-thickness center is limited to a temperature of $Ar_3$+15° C. or more. Incidentally, $Ar_3$ used is a value determined by a thermal expansion test, e.g., as described in Examples.

When the average cooling rate of the through-thickness center is less than 3.5° C./sec, a ferrite phase is formed to reduce the yield strength. Therefore, the average cooling rate of the through-thickness center from 700° C. to 500° C. is limited to 3.5° C./sec or more.

In the present invention, a tempering step of performing tempering at a temperature of 700° C. or lower after the cooling step may be preferably further included.

When the tempering temperature is higher than 700° C., the ferrite phase is formed to reduce the yield strength of the steel plate. Therefore, the tempering temperature is limited to 700° C. or lower. Incidentally, the tempering temperature is preferably 650° C. or lower.

EXAMPLES

Examples of the present invention are described below. The present invention is not limited to the examples.

Table 1 shows the composition of steels used for evaluation. Steels A to H have a composition meeting the preferred scope of the present invention. Steels I to M have a composition outside the preferred scope of the present invention are comparative examples.

Steel plates were manufactured under conditions shown in Table 2 using these steels. The obtained steel plates were evaluated for microstructure, material strength, and toughness. The evaluation results are shown in Table 3.

The through-thickness center temperature was measured during the rolling of each steel plate in such a manner that thermocouples were attached to the longitudinal, transverse, and through-thickness centers of the steel plate.

Determination of $Ar_3$

An 8 mm φ×12 mm sample was taken from a (¼)t (t represents the thickness) position of each slab used for steel plate rolling and was subjected to the thermal expansion test under conditions shown in FIG. 1 and $Ar_3$ was evaluated from transformation expansion.

Area Fraction of Polygonal Ferrite

Each obtained steel plate was identified for microstructure and was measured for area fraction (%). The microstructure of the steel plate was observed in such a manner that for a through-thickness cross section parallel to the rolling direction of the steel plate, a microstructure exposed by corrosion with 3% nital was observed with a SEM (scanning electron microscope) under the following conditions: a magnification of 2,000× and ten fields of view. This was analyzed with an image analysis software program (Image-Pro, developed by Cybernetics). An image was prepared by digitizing phases into an applicable phase and phases other than this phase. Since a martensite phase and a retained austenite phase were difficult to distinguish, these phases were digitized on the assumption that these phases were regarded as the same. The area fraction of a polygonal ferrite phase was determined from these using a function of the software program. Main phases were bainite and martensite microstructures.

Measurement of Effective Grain Size

For microstructural size, after samples were taken from the longitudinal, transverse, and through-thickness centers of each steel plate and were mirror-polished, EBSP analysis was performed under conditions below and the equivalent circle diameter of a microstructure surrounded by high angle grain boundaries with a misorientation of 15° or more with respect to neighboring grains was evaluated as the effective grain size from an obtained orientation map. The effective grain size (average) and the standard deviation thereof were derived on the basis of the evaluation results.

EBSP Conditions

Analysis region: a 1 mm×1 mm region of the through-thickness center

Step Size: 0.4 μm

Measurement of Yield Strength and Tensile Strength

A JIS No. 4 tensile specimen perpendicular to the rolling direction was taken from a position directly close to the through-thickness center of an EBSP sample of each obtained steel plate, was subjected to a tensile test in accordance with JIS Z 2241 (1998) standards, and was evaluated for yield strength and tensile strength.

A V-notch specimen perpendicular to the rolling direction was taken from a position directly close to the through-thickness center of an EBSP sample of the obtained steel plate in accordance with JIS Z 2202 (1998) standards, was subjected to a Charpy impact test in accordance with JIS Z 2242 (1998) standards, and was evaluated for ductile-to-brittle fracture transition temperature (hereinafter also designated as vTrs). For evaluation standards, one with −60° C. or lower was evaluated to be excellent in low-temperature toughness.

TABLE 1

Table 1 Composition of steel (mass percent)

| Steel type | C | Si | Mn | P | S | Al | Nb | Cu | Ni | Cr | Mo | Ti | N |
|---|---|---|---|---|---|---|---|---|---|---|---|---|---|
| A | 0.076 | 0.30 | 1.82 | 0.007 | 0.0021 | 0.041 | 0.026 | 0.35 | 0.32 | 0.18 | 0.01 | 0.015 | 0.0045 |
| B | 0.043 | 1.92 | 1.12 | 0.011 | 0.0016 | 0.023 | 0.016 | 0.10 | 0.13 | 0.51 | 0.18 | 0.007 | 0.0033 |
| C | 0.126 | 0.71 | 0.85 | 0.007 | 0.0008 | 0.003 | 0.029 | 0.32 | 1.15 | 0.02 | 0.01 | 0.005 | 0.0026 |
| D | 0.116 | 1.22 | 1.61 | 0.006 | 0.0009 | 0.031 | 0.013 | 0.16 | 0.37 | 0.02 | 0.16 | 0.011 | 0.0032 |
| E | 0.055 | 0.17 | 1.47 | 0.006 | 0.0025 | 0.028 | 0.046 | 0.31 | 0.24 | 0.02 | 0.01 | 0.038 | 0.0086 |
| F | 0.083 | 0.51 | 1.33 | 0.004 | 0.0036 | 0.031 | 0.024 | 0.46 | 0.94 | 0.91 | 0.35 | 0.022 | 0.0056 |
| G | 0.076 | 0.13 | 1.59 | 0.005 | 0.0006 | 0.016 | 0.013 | 0.64 | 1.54 | 0.02 | 0.01 | 0.008 | 0.0028 |
| H | 0.147 | 0.80 | 1.96 | 0.006 | 0.0008 | 0.027 | 0.022 | 0.19 | 0.56 | 0.51 | 0.14 | 0.013 | 0.0034 |
| I* | 0.103 | 0.26 | 1.32 | 0.013 | 0.0016 | 0.029 | 0.013 | 0.13 | 0.02 | 0.02 | 0.01 | 0.018 | 0.0041 |
| J* | 0.061 | 0.21 | 1.16 | 0.008 | 0.0009 | 0.036 | 0.006* | 0.40 | 0.51 | 0.02 | 0.01 | 0.009 | 0.0031 |
| K* | 0.092 | 0.38 | 1.75 | 0.006 | 0.0026 | 0.019 | 0.021 | 0.16 | 0.36 | 0.02 | 0.01 | 0.004* | 0.0032 |
| L* | 0.115 | 0.19 | 1.34 | 0.005 | 0.0013 | 0.022 | 0.013 | 0.31 | 0.25 | 0.15 | 0.01 | 0.030 | 0.0055 |
| M* | 0.069 | 0.15 | 1.06 | 0.003 | 0.0015 | 0.031 | 0.056* | 0.36 | 0.31 | 0.02 | 0.01 | 0.011 | 0.0032 |

TABLE 1-continued

Table 1 Composition of steel (mass percent)

| Steel type | Ti/N | Cu + Ni + Cr + Mo | V | W | B | Ca | REM | Mg | Categories |
|---|---|---|---|---|---|---|---|---|---|
| A | 3.3 | 0.9 | — | — | — | — | — | — | Inventive Example |
| B | 2.1 | 0.9 | — | — | — | — | — | — | Inventive Example |
| C | 1.9 | 1.5 | — | — | — | 0.0018 | — | — | Inventive Example |
| D | 3.4 | 0.7 | 0.06 | — | — | — | — | — | Inventive Example |
| E | 4.4 | 0.6 | — | 0.13 | — | — | — | — | Inventive Example |
| F | 3.9 | 2.7 | — | — | 0.0011 | — | — | — | Inventive Example |
| G | 2.9 | 2.2 | — | — | — | — | 0.0078 | — | Inventive Example |
| H | 3.8 | 1.4 | 0.05 | — | — | | — | 0.0011 | Inventive Example |
| I* | 4.4 | 0.2* | — | — | — | 0.0025 | — | — | Comparative Example |
| J* | 2.9 | 0.9 | — | 0.08 | — | — | — | — | Comparative Example |
| K* | 1.3* | 0.6 | 0.04 | — | 0.0015 | — | — | — | Comparative Example |
| L* | 5.5* | 0.7 | — | — | — | — | 0.0052 | — | Comparative Example |
| M* | 3.4 | 0.7 | — | — | — | — | — | 0.0024 | Comparative Example |

Note:
Asterisked items are outside the preferred scope of the present invention.

TABLE 2

Table 2 Method for manufacturing steel plate

| No. | Steel type | Heating temperature (° C.) | Pass schedule at 930° C. or higher | | | | | | | | |
|---|---|---|---|---|---|---|---|---|---|---|---|
| | | | Pass No. | 1 | 2 | 3 | 4 | 5 | 6 | 7 | 8 |
| 1 | A | 1080 | ½t temperature | 1043 | 1038 | 1032 | 1027 | 960 | 954 | — | — |
| | | | Rolling reduction (%) | 7.6 | 8.1 | 9.3 | 11.1 | 12.9 | 15.1 | — | — |
| | | | ld/hm | 0.41 | 0.44 | 0.50 | 0.57 | 0.67 | 0.78 | — | — |
| 2 | B | 1030 | ½t temperature | 1005 | 1002 | 998 | 995 | 990 | — | — | — |
| | | | Rolling reduction (%) | 5.8 | 9.0 | 10.3 | 8.0 | 7.6 | — | — | — |
| | | | ld/hm | 0.38 | 0.50 | 0.57 | 0.52 | 0.53 | — | — | — |
| 3 | C | 1150 | ½t temperature | 1089 | 1085 | 1081 | 981 | 973 | 965 | — | — |
| | | | Rolling reduction (%) | 5.2 | 9.5 | 12.2 | 13.9 | 15.4 | 13.0 | — | — |
| | | | ld/hm | 0.40 | 0.58 | 0.70 | 0.81 | 0.93 | 0.91 | — | — |
| 4 | D | 1030 | ½t temperature | 990 | 984 | 980 | 970 | 964 | 960 | 955 | — |
| | | | Rolling reduction (%) | 3.5 | 7.7 | 9.4 | 12.8 | 13.3 | 19.0 | 15.0 | — |
| | | | ld/hm | 0.27 | 0.42 | 0.49 | 0.61 | 0.67 | 0.90 | 0.86 | — |
| 5 | E | 1100 | ½t temperature | 1062 | 1060 | 1056 | 952 | 948 | 945 | 943 | 939 |
| | | | Rolling reduction (%) | 4.6 | 10.1 | 8.1 | 6.3 | 11.5 | 10.0 | 9.8 | 13.0 |
| | | | ld/hm | 0.34 | 0.53 | 0.50 | 0.45 | 0.65 | 0.64 | 0.67 | 0.83 |
| 6 | F | 1130 | ½t temperature | 1084 | 1080 | 1076 | 1074 | 952 | 949 | 947 | 945 |
| | | | Rolling reduction (%) | 4.8 | 8.5 | 9.3 | 6.1 | 8.7 | 8.6 | 11.5 | 11.8 |
| | | | ld/hm | 0.32 | 0.44 | 0.49 | 0.41 | 0.51 | 0.53 | 0.65 | 0.71 |
| 7 | G | 960 | ½t temperature | 942 | 940 | 938 | 936 | 933 | — | — | — |
| | | | Rolling reduction (%) | 6.0 | 9.8 | 9.0 | 11.9 | 11.2 | — | — | — |
| | | | ld/hm | 0.40 | 0.54 | 0.54 | 0.67 | 0.68 | — | — | — |
| 8 | H | 1000 | ½t temperature | 976 | 973 | 972 | 970 | 965 | — | — | — |
| | | | Rolling reduction (%) | 3.8 | 10.9 | 10.0 | 8.6 | 10.8 | — | — | — |
| | | | ld/hm | 0.34 | 0.62 | 0.62 | 0.61 | 0.72 | — | — | — |
| 9 | I* | 1050 | ½t temperature | 1025 | 1021 | 1017 | 1014 | 951 | 949 | 946 | — |
| | | | Rolling reduction (%) | 3.2 | 5.0 | 10.2 | 10.2 | 12.2 | 9.4 | 7.1 | — |
| | | | ld/hm | 0.26 | 0.33 | 0.50 | 0.53 | 0.62 | 0.57 | 0.51 | — |
| 10 | J* | 1120 | ½t temperature | 1084 | 1076 | 1070 | 962 | 959 | 956 | — | — |
| | | | Rolling reduction (%) | 3.6 | 3.7 | 9.6 | 9.8 | 10.4 | 10.5 | — | — |
| | | | ld/hm | 0.29 | 0.30 | 0.51 | 0.54 | 0.59 | 0.63 | — | — |
| 11 | K* | 1060 | ½t temperature | 1028 | 1024 | 1020 | 1016 | 1013 | — | — | — |
| | | | Rolling reduction (%) | 4.8 | 9.5 | 12.2 | 14.5 | 15.4 | — | — | — |
| | | | ld/hm | 0.38 | 0.57 | 0.70 | 0.82 | 0.93 | — | — | — |
| 12 | L* | 1030 | ½t temperature | 1005 | 1003 | 1000 | 997 | — | — | — | — |
| | | | Rolling reduction (%) | 4.4 | 9.2 | 8.3 | 11.1 | — | — | — | — |
| | | | ld/hm | 0.34 | 0.52 | 0.51 | 0.63 | — | — | — | — |
| 13 | M* | 1080 | ½t temperature | 1039 | 1035 | 1031 | 960 | 958 | 956 | — | — |
| | | | Rolling reduction (%) | 4.0 | 6.9 | 9.7 | 10.7 | 8.3 | 9.1 | — | — |
| | | | ld/hm | 0.29 | 0.40 | 0.50 | 0.56 | 0.51 | 0.56 | — | — |
| 14 | C | 1060 | ½t temperature | 1025 | 1020 | 1017 | 1014 | 942 | 940 | — | — |
| | | | Rolling reduction (%) | 3.8 | 3.6 | 2.1 | 8.5 | 5.6 | 5.9 | — | — |
| | | | ld/hm | 0.31 | 0.30 | 0.23 | 0.50 | 0.41 | 0.44 | — | — |

TABLE 2-continued

Table 2 Method for manufacturing steel plate

| | | | | | | | | | | | |
|---|---|---|---|---|---|---|---|---|---|---|---|
| 15 | F | 1180* | ½t temperature | 1132 | 1125 | 1120 | 975 | 971 | 968 | — | — |
| | | | Rolling reduction (%) | 5.0 | 4.9 | 4.7 | 9.8 | 11.9 | 10.1 | — | — |
| | | | ld/hm | 0.35 | 0.36 | 0.36 | 0.55 | 0.65 | 0.63 | — | — |
| 16 | A | 1070 | ½t temperature | 1032 | 1028 | 1025 | 981 | 976 | 972 | 969 | — |
| | | | Rolling reduction (%) | 4.3 | 6.0 | 9.0 | 12.8 | 12.7 | 12.2 | 9.6 | — |
| | | | ld/hm | 0.36 | 0.44 | 0.57 | 0.74 | 0.78 | 0.82 | 0.76 | — |
| 17 | B | 1100 | ½t temperature | 1063 | 1060 | 1054 | 950 | 947 | 943 | — | — |
| | | | Rolling reduction (%) | 3.6 | 2.9 | 8.5 | 8.4 | 8.2 | 11.1 | — | — |
| | | | ld/hm | 0.30 | 0.28 | 0.50 | 0.52 | 0.53 | 0.66 | — | — |
| 18 | D | 1070 | ½t temperature | 1032 | 1028 | 1025 | 981 | 976 | 972 | 969 | — |
| | | | Rolling reduction (%) | 4.3 | 6.0 | 9.0 | 12.8 | 12.7 | 12.2 | 9.6 | — |
| | | | ld/hm | 0.36 | 0.44 | 0.57 | 0.74 | 0.78 | 0.82 | 0.76 | — |
| 19 | G | 1030 | ½t temperature | 1005 | 1002 | 999 | 995 | 990 | — | — | — |
| | | | Rolling reduction (%) | 4.8 | 6.4 | 8.8 | 9.6 | 11.2 | — | — | — |
| | | | ld/hm | 0.37 | 0.44 | 0.54 | 0.60 | 0.69 | — | — | — |

| No. | Sum of rolling reductions due to a pass with an ld/hm of 0.5 or more at lower than 930° C. (%) | Cooling start temperature (° C.) | Ar3 temperature (° C.) | Average cooling rate from 700° C. to 500° C. (° C./sec) | Tempering temperature (° C.) | Categories |
|---|---|---|---|---|---|---|
| 1 | 58 | 745 | 725 | 5.6 | — | Inventive Example |
| 2 | 63 | 792 | 776 | 7.6 | 630 | Inventive Example |
| 3 | 41 | 766 | 746 | 3.9 | — | Inventive Example |
| 4 | 39 | 760 | 736 | 11.3 | 590 | Inventive Example |
| 5 | 45 | 782 | 760 | 6.3 | — | Inventive Example |
| 6 | 66 | 734 | 706 | 10.5 | 610 | Inventive Example |
| 7 | 37 | 692 | 672 | 18.3 | 550 | Inventive Example |
| 8 | 75 | 706 | 680 | 13.1 | 580 | Inventive Example |
| 9 | 50 | 813 | 776 | 9.5 | — | Comparative Example |
| 10 | 52 | 803 | 770 | 7.3 | 550 | Comparative Example |
| 11 | 46 | 751 | 730 | 11.1 | — | Comparative Example |
| 12 | 40 | 780 | 758 | 4.8 | — | Comparative Example |
| 13 | 56 | 805 | 788 | 6.5 | — | Comparative Example |
| 14 | 66 | 761 | 734 | 7.1 | — | Comparative Example |
| 15 | 53 | 738 | 706 | 10.3 | 610 | Comparative Example |
| 16 | 30* | 750 | 725 | 4.8 | — | Comparative Example |
| 17 | 66 | 784* | 776 | 6.2 | 610 | Comparative Example |
| 18 | 48 | 717* | 724 | 3.0* | 590 | Inventive Example |
| 19 | 50 | 700 | 672 | 7.2 | 750* | Comparative Example |

Note:

Asterisked items are outside the preferred scope of the present invention (although being not asterisked, No. 14's pass schedule at 930° C. or higher is outside the preferred scope of the present invention).

TABLE 3

Table 3 Characteristics of steel plate

| No. | Steel type | Area fraction of polygonal ferrite (%) | Average effective grain size (μm) | Standard deviation of average effective grain size (μm) | Yield strength (MPa) | Tensile strength (MPa) | vTrs (° C.) | Categories |
|---|---|---|---|---|---|---|---|---|
| 1 | A | 1 | 9.5 | 6.6 | 535 | 622 | −75 | Inventive Example |
| 2 | B | 1 | 8.7 | 5.9 | 520 | 646 | −80 | Inventive Example |
| 3 | C | 3 | 14.1 | 9.4 | 512 | 631 | −61 | Inventive Example |
| 4 | D | 1 | 7.7 | 5.6 | 551 | 680 | −72 | Inventive Example |
| 5 | E | 5 | 11.3 | 7.5 | 502 | 606 | −73 | Inventive Example |
| 6 | F | 0 | 12.2 | 8.1 | 668 | 735 | −63 | Inventive Example |
| 7 | G | 2 | 7.3 | 6.3 | 560 | 676 | −81 | Inventive Example |
| 8 | H | 0 | 9.6 | 6.9 | 570 | 792 | −65 | Inventive Example |
| 9 | I* | 8 | 13.5 | 8.7 | 448 | 535 | −80 | Comparative Example |
| 10 | J* | 4 | 17.2* | 9.5 | 420 | 539 | −46 | Comparative Example |
| 11 | K* | 0 | 18.9* | 9.4 | 578 | 657 | −43 | Comparative Example |
| 12 | L* | 1 | 12.8 | 8.5 | 503 | 616 | −50 | Comparative Example |
| 13 | M* | 2 | 11.3 | 9.2 | 526 | 633 | −48 | Comparative Example |
| 14 | C | 1 | 20.1* | 8.4 | 512 | 622 | −40 | Comparative Example |
| 15 | F | 0 | 19.6* | 11.6* | 697 | 745 | −42 | Comparative Example |
| 16 | A | 1 | 21.3* | 10.5* | 514 | 617 | −47 | Comparative Example |
| 17 | B | 13* | 13.8 | 11.0* | 484 | 606 | −53 | Comparative Example |
| 18 | D | 4 | 12.9 | 9.1 | 489 | 624 | −68 | Inventive Example |
| 19 | G | 15* | 14.5 | 11.5* | 490 | 603 | −53 | Comparative Example |

Note:
Asterisked items are outside the preferred scope of the present invention.

Nos. 1 to 8 and 18 are inventive examples and Nos. 9 to 17 and 19 are comparative examples.

The inventive examples, which were obtained in accordance with aspects of the present invention, have excellent strength and low-temperature toughness, that is, a yield strength of 500 MPa or more, a tensile strength of 600 MPa or more, and a vTrs of −60° C. or lower.

No. 9 has no necessary strength because the total content of Cu, Ni, Cr, and Mo is less than the preferred scope of the present invention.

No. 10 has reduced toughness and no necessary strength because the content of Nb is less than the preferred scope of the present invention, non-recrystallization region rolling could not be effectively performed, and therefore the effective grain size is large.

No. 11 has low toughness because the content of Ti is small, Ti/N is less than the preferred scope of the present invention, γ grains become coarse during slab heating, and therefore the effective grain size of a final microstructure is large.

No. 12 has low toughness because Ti/N is greater than the preferred scope of the present invention and coarse Ti precipitates were formed.

No. 13 has low toughness because the content of Nb is greater than the preferred scope of the present invention.

No. 14 has low toughness because conditions for rolling in a recrystallization temperature region are lower than desirable conditions and therefore the effective grain size is large.

No. 15 has low toughness because the heating temperature is higher than a proper range, γ grains become coarse during slab heating, and therefore the effective grain size of a final microstructure is large.

No. 16 has low toughness because conditions for rolling in a non-recrystallization temperature region are outside the preferred scope of the present invention and therefore the effective grain size is large.

No. 17 has reduced toughness and reduced strength because the cooling start temperature is lower than the preferred scope of the present invention, polygonal ferrite was formed, and therefore the standard deviation of the effective grain size is large.

No. 18 has somewhat lower strength as compared to preferable inventive examples because the cooling rate is outside the preferable scope of a manufacturing method.

No. 19 has reduced toughness and reduced strength because the tempering temperature is higher than the preferred scope of the present invention, polygonal ferrite was formed, and therefore the standard deviation of the effective grain size is large.

The invention claimed is:

1. A steel plate containing 0.04% to 0.15% C, 0.1% to 2.0% Si, 0.8% to 2.0% Mn, 0.025% or less P, 0.020% or less S, 0.001% to 0.100% Al, 0.010% to 0.050% Nb, and 0.005% to 0.050% Ti on a mass basis, the steel plate further containing Cu, Ni, Cr, Mo, and N on a mass basis such that 0.5%≤Cu+Ni+Cr+Mo≤3.0% and 1.8≤Ti/N≤4.5 are satisfied, a remainder being Fe and inevitable impurities, wherein an area fraction of polygonal ferrite is less than 10%, the effective grain size at the through-thickness center is 15 μm or less, and a standard deviation of the effective grain size is 10 μm or less.

2. The steel plate according to claim 1, further containing one or more of 0.01% to 0.10% V, 0.01% to 1.00% W, 0.0005% to 0.0050% B, 0.0005% to 0.0060% Ca, 0.0020% to 0.0200% of a REM, and 0.0002% to 0.0060% Mg on a mass basis.

3. A method for manufacturing the steel plate according to claim 1, comprising:

a heating step of heating a steel plate having a composition specified in claim 1 to a temperature of 950° C. to 1,150° C.;

a recrystallization temperature region rolling step of performing rolling with a rolling shape factor of 0.5 or more and a rolling reduction of 6.0% or more per pass at a through-thickness center temperature of 930° C. to 1,050° C. three or more passes after the heating step;

a non-recrystallization temperature region rolling step of performing rolling with a rolling shape factor of 0.5 or more and a-total rolling reduction of 35% or more at the through-thickness center temperature of lower than 930° C. one or more passes after the recrystallization temperature region rolling step; and a cooling step of performing cooling under conditions where cooling is started at the through-thickness center temperature of $Ar_3$+15° C. or more and an average cooling rate of the through-thickness center from 700° C. to 500° C. is 3.5° C./sec or more after the non-recrystallization temperature region rolling step.

4. The method for manufacturing the steel plate according to claim 3, further comprising a tempering step of tempering at a temperature of 700° C. or lower after the cooling step.

* * * * *